US009296591B2

(12) United States Patent
Garfinkel et al.

(10) Patent No.: US 9,296,591 B2
(45) Date of Patent: Mar. 29, 2016

(54) DETERMINING ELEVATOR CAR POSITION USING BI-STABLE SENSORS

(75) Inventors: Michael Garfinkel, West Hartford, CT (US); Ronnie E. Thebeau, Haddam, CT (US); Leslie C. Watterson, Unionville, CT (US); SuCheol Lee, Masan/KyoungNam (KR); Kensaku Yamane, Narita (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 651 days.

(21) Appl. No.: 13/703,970

(22) PCT Filed: Jun. 16, 2010

(86) PCT No.: PCT/US2010/038798

§ 371 (c)(1),
(2), (4) Date: Dec. 13, 2012

(87) PCT Pub. No.: WO2011/159290

PCT Pub. Date: Dec. 22, 2011

(65) Prior Publication Data

US 2013/0081909 A1 Apr. 4, 2013

(51) Int. Cl.
*B66B 1/34* (2006.01)

(52) U.S. Cl.
CPC ..... *B66B 1/3492* (2013.01)

(58) Field of Classification Search
CPC ..... B66B 1/3492
USPC ..... 187/247, 277, 391, 394
See application file for complete search history.

(56) References Cited

U.S. PATENT DOCUMENTS

| | | | | |
|---|---|---|---|---|
| 3,963,098 | A * | 6/1976 | Lewis et al. | 187/394 |
| 4,083,430 | A * | 4/1978 | Gingrich | 187/394 |
| 4,191,277 | A | 3/1980 | Meyer et al. | |
| 4,245,721 | A * | 1/1981 | Masel | 187/394 |
| 4,798,267 | A * | 1/1989 | Foster et al. | 187/389 |
| 5,135,081 | A * | 8/1992 | Watt et al. | 187/394 |
| 5,637,841 | A * | 6/1997 | Dugan et al. | 187/294 |
| 5,889,239 | A * | 3/1999 | Blackaby et al. | 187/391 |
| 6,032,761 | A * | 3/2000 | Coste et al. | 187/294 |
| 6,082,498 | A * | 7/2000 | Coste et al. | 187/291 |
| 6,435,315 | B1 | 8/2002 | Zaharia | |

(Continued)

FOREIGN PATENT DOCUMENTS

| | | |
|---|---|---|
| JP | 62-280174 | 12/1987 |
| JP | H01121674 A | 5/1989 |

(Continued)

OTHER PUBLICATIONS

Korean Office Action translation for application KR10-2013-7001114, mailed May 21, 2014, 4 pages.

(Continued)

*Primary Examiner* — Anthony Salata
(74) *Attorney, Agent, or Firm* — Cantor Colburn LLP

(57) ABSTRACT

A system for monitoring elevator car travel includes a plurality of bi-stable sensors (12) traveling with an elevator car (10); a plurality of sense elements (20) positioned along a path of the sensors (12); the sense elements (20) causing the sensors (12) to assume one of a first state and a second state; wherein states of the sensors (12) define a zone code (30) identifying a zone corresponding to the elevator car (10) position, the zone code (30) being a gray code.

16 Claims, 4 Drawing Sheets

(56) References Cited

U.S. PATENT DOCUMENTS

| | | | | |
|---|---|---|---|---|
| 7,537,092 | B2 | 5/2009 | Birrer et al. | |
| 7,597,176 | B2 * | 10/2009 | Zaharia | 187/394 |
| 2003/0070883 | A1 * | 4/2003 | Foster et al. | 187/394 |
| 2004/0174161 | A1 * | 9/2004 | Tausch et al. | 324/207.22 |
| 2005/0039987 | A1 * | 2/2005 | Redden | 187/394 |

FOREIGN PATENT DOCUMENTS

| | | | |
|---|---|---|---|
| JP | H01313280 | A | 12/1989 |
| JP | 08319072 | A | 12/1996 |
| JP | 2002068619 | A | 3/2002 |
| JP | 2002226149 | A | 8/2002 |
| JP | 2006052092 | A | 2/2006 |
| JP | 2006256795 | A | 9/2006 |
| JP | 2006315823 | A | 11/2006 |
| JP | 2007045551 | A | 2/2007 |
| KR | 1020070042295 | A | 4/2007 |
| KR | 101474345 | B1 | 12/2014 |
| WO | 2009073025 | A1 | 6/2009 |

OTHER PUBLICATIONS

PCT International Search Report and Written Opinion of the International Searching Authority for International Application No. PCT/US2010/038798, Mar. 18, 2011, 9 pages.

PCT International Preliminary Report on Patentability and Written Opinion of the International Searching Authority for International Application No. PCT/US2010/038798, Dec. 19, 2012, 6 pages.

Japanese Office Action for application JP 2013-515306, dated Nov. 19, 2014, 3 pages.

Malaysian Office Action and Search Report, dated Oct. 30, 2015, 3 pages.

* cited by examiner

DETERMINING ELEVATOR CAR POSITION USING BI-STABLE SENSORS

BACKGROUND OF THE INVENTION

The subject matter disclosed herein relates to determining elevator car position. More particularly, the subject matter disclosed herein relates to determining elevator car position using bi-stable sensors.

It is known in the elevator art to define terminal zones at both ends of the elevator hoistway. The top landing of the building will normally be located within the top terminal zone as will the lower landing be located within the bottom terminal zone. It is desired that the elevator car stop normally at a top or bottom landing of the hoistway in such a terminal zone. As a safety measure, it is necessary to provide a number of backup means to ensure the elevator car does not collide with the mechanical hard-limits. Three levels of protection are usually provided when the elevator enters a terminal zone: the Normal Stopping Device, the Normal Terminal Stopping Device (or NTSD), and the Emergency Terminal Speed Limiting Device (or ETSLD). Embodiments of the invention may be used with NTSD which will take over from the Normal Stopping Device should the normal speed control signals fail to stop the car at the designated positions at the upper and lower ends of the hoistway. Two similar NTSDs are usually provided in the two terminal zones. One NTSD is installed at the bottom of the hoistway and one NTSD at the top of the hoistway. The NTSD system is designed to override the normal speed command signals and bring the car to stop at the terminal. It is also designed such that the NTSD terminal speed profile causes the slowdown pattern to be relatively smooth.

In order to implement the NTSDs, the position of the elevator car needs to be known by a control system. One existing method of determining elevator car position employs three sensors for detecting car position and a fourth sensor as a latching or clock input. The clock input indicates when the three sensors should be read to determine car position. As system noise can cause false clocking signals, improvements to such systems would be well received in the art. In addition, positions identified through the use of a simple binary code is sub-optimal in the required number of sense elements.

BRIEF DESCRIPTION OF THE INVENTION

According to one aspect of the invention, a system for monitoring elevator car travel includes a plurality of bi-stable sensors traveling with an elevator car; a plurality of sense elements positioned along a path of the sensors; the sense elements causing the sensors to assume one of a first state and a second state; wherein states of the sensors define a zone code identifying a zone corresponding to the elevator car position, the zone code being a gray code.

According to one aspect of the invention a method for monitoring elevator car travel includes positioning a plurality of bi-stable sensors to travel with an elevator car; positioning a plurality of sense elements along a path of the sensors; the sense elements causing the sensors to assume one of a first state and a second state; obtaining states of the sensors, wherein the states of the sensors define a zone code identifying a zone corresponding to the elevator car position, the zone code being a gray code.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
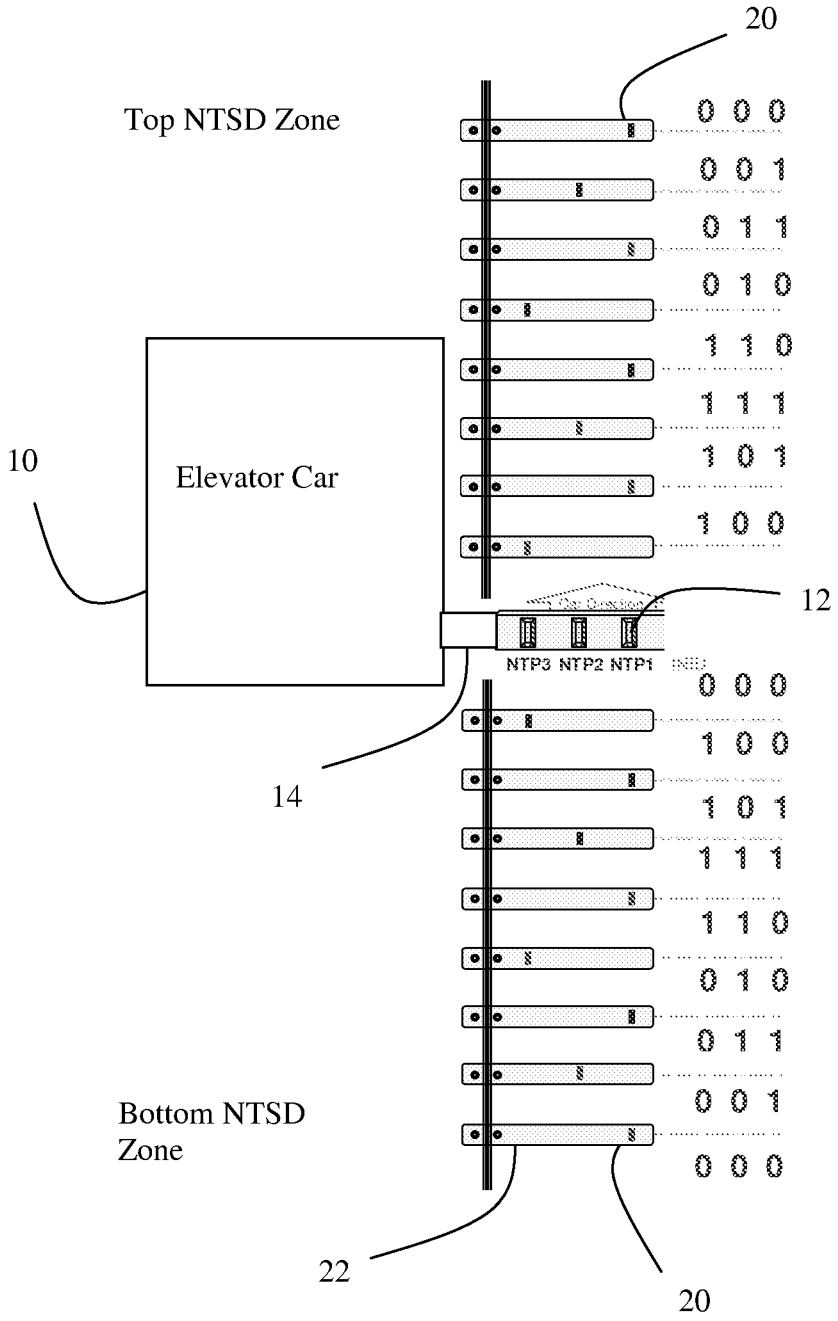
FIG. 1 depicts an elevator car and top and bottom NTSD zones.

FIG. 1 depicts an elevator car and top and bottom NTSD zones. As known in the art, certain safety systems need to know the elevator car zone in order to apply the appropriate safety measure (e.g., reduce car speed). The exemplary embodiment of FIG. 1 includes a car 10 having a plurality of sensors 12 mounted to the car 10. In the embodiment of FIG. 1, three sensors 12 are employed, but it is understood that any number of sensors may be used.

Sensors 12 travel with car 10, and may be mounted directly to the car 10 or on a support 14 extending from the car 10. Sensors 12 are positioned and spaced to correspond to sense elements 20. As described in further detail herein, sensors 12 are bi-stable sensors, meaning sensors 12 maintain a first state until being toggled to a second state, and vice versa. To change state, the sensors 12 need to be exposed to energy initiating the change in state; mere absence of a sensed element 20 will not cause the state of sensor 12 to change. In an exemplary embodiment, sensors 12 are bi-stable reed switches sensitive to magnetic energy. It is understood that other types of bi-stable sensors may be used (e.g., optical).

Sense elements 20 are positioned along a path of travel of the sensors 12. The sense elements 20 are positioned and spaced to correspond to the positions and spacing of the sensors 12. Sense elements 20 may be mounted in the hoistway, if sensors 12 travel within the hoistway. As long as the sensors 12 pass close enough to the sense elements 20 to detect the sense elements 20, the exact mounting location in the elevator system is not critical.

The sense elements 20 are mounted on vanes 22, with each vane positioned at a transition between zones. As described in further detail herein, as the group of sensors 12 passes each zone boundary, one of the sensors 12 changes states in response to a sense element 20 positioned at the boundary between the zones. As only one sensor 12 changes state at each zone transition, the zone code 30 generated by the sensors 12 follows a gray code. As known in the art, a gray code is a series of binary numbers in which only a single bit changes from one element in the series to the next.

Figure 2:
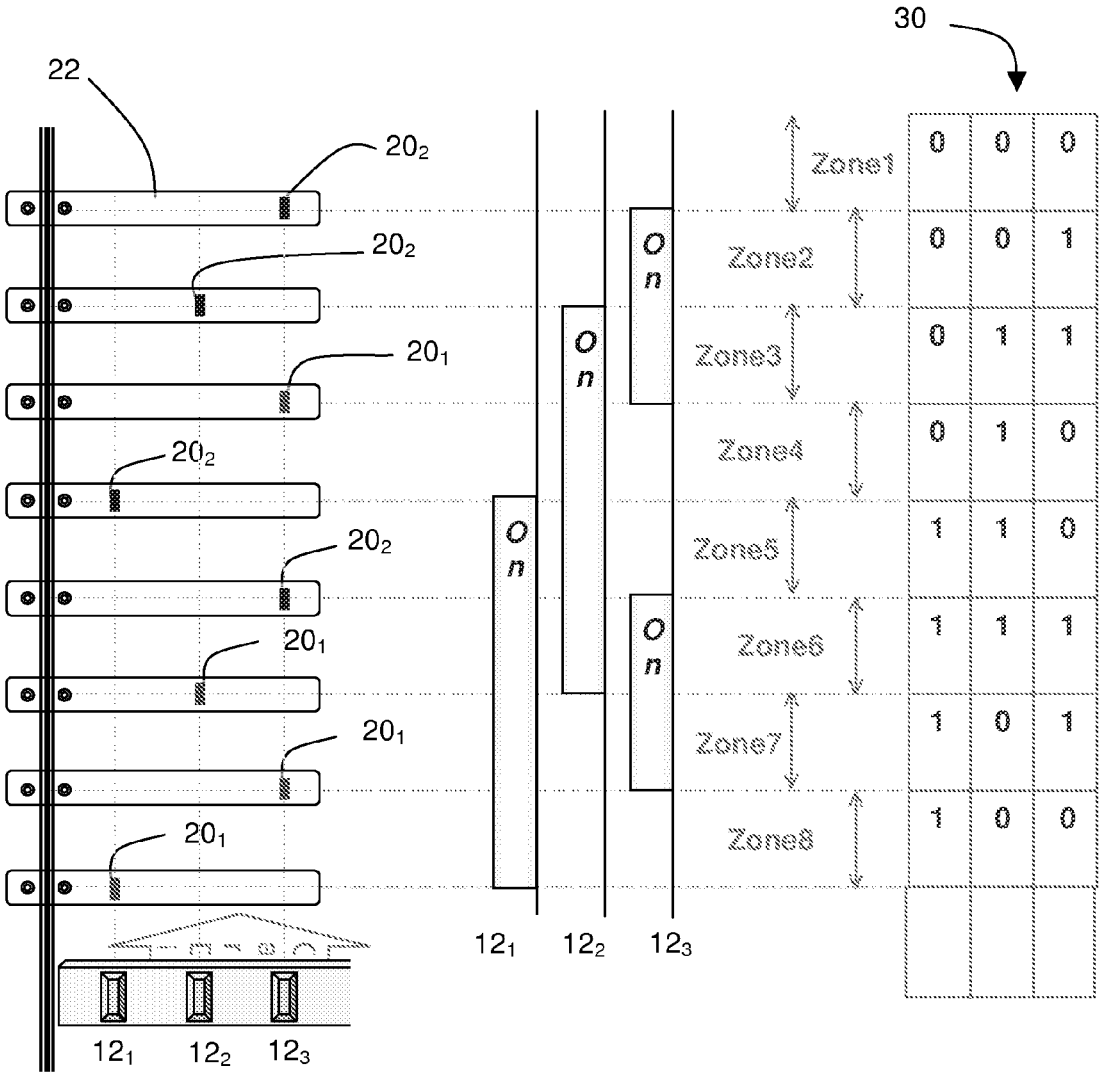
FIG. 2 depicts the top NTSD zone.

FIG. 2 depicts the top NTSD zone, the on and off states of the sensors 12 and the zone code 30 generated by the three sensors 12 as the car travels along the top zones. The sense elements 20 include two types of sense elements having different characteristics. Sense elements $\mathbf{20}_1$ have a first characteristic and sense elements $\mathbf{20}_2$ have a second characteristic, different from the first characteristic. In an exemplary embodiment, the first sense element $\mathbf{20}_1$ is a north polarity magnet and the second sense element $\mathbf{20}_2$ is a south polarity magnet. It is understood that other characteristics (e.g., wavelength of light) may be used to provide the two different sense elements $20_1$ and $20_2$. The different characteristics of the sense elements $20_1$ and $20_2$ cause the sensors 12 to assume different states.

The direction of travel of the car 10 also affects the state of the sensor 12. For example, when the car 10 (and sensors 12) is traveling upwards, the first sense element $20_1$ causes the sensor 12 to assume a first value (e.g., a logic 1) and the second sense element $20_2$ causes the sensor 12 to assume a second value (e.g., logic 0). Alternatively, when the car 10 (and sensors 12) is traveling downwards, the first sense element $20_1$ causes the sensor 12 to assume the second value (e.g., a logic 0) and the second sense element $20_2$ causes the sensor 12 to assume a first value (e.g., logic 1).

FIG. 2 illustrates the on (e.g., logic 1) and off (e.g., logic 0) states of the three sensor $12_1$, $12_2$, $12_3$. FIG. 2 also depicts the zone code 30 as the sensors travel through each zone. The zone code corresponds to the state of sensors $12_1$, $12_2$, and $12_3$. The state of sensors $12_1$, $12_2$ and $12_3$ is altered when the sensor passes proximate to a sensed element 20. The sensors 12 and sense elements 20 are positioned and spaced so that a sensor 12 will not change state if it is not the closest sensor 12 to a sensed element 20. Each vane 22 includes a single sense element 20 so that only a single bit is changed upon the transition from one zone to the next. Accordingly, the zone code 30 is a gray code.

In the example of an upwardly moving car 10, the zone code is initially 000 when the car 10 is between the top zones and the bottom zones (shown in FIG. 1). As the car moves upwards through the zones (approaching terminal zone 1), the zone code 30 changes by one bit as the car 10 passes through each zone. Eventually the zone code 30 becomes 000 again as the car enters the terminal zone 1. A controller, described in further detail herein, monitors the zone code 30 to determine what zone the car 10 is in and the appropriate safety measures, in any, for that zone.

As the car moves downward through the top zone, the states of sensor $12_1$, $12_2$, $12_3$ are altered by the sensors 12 passing the sense elements 20. When the car 10 is moving downwards, the sense elements 20 have the opposite effect on the states of sensors 12 (as compared to an upwardly moving car) and the zone code 30 is the same for each zone, regardless of whether the car is moving up or down.

Figure 3:
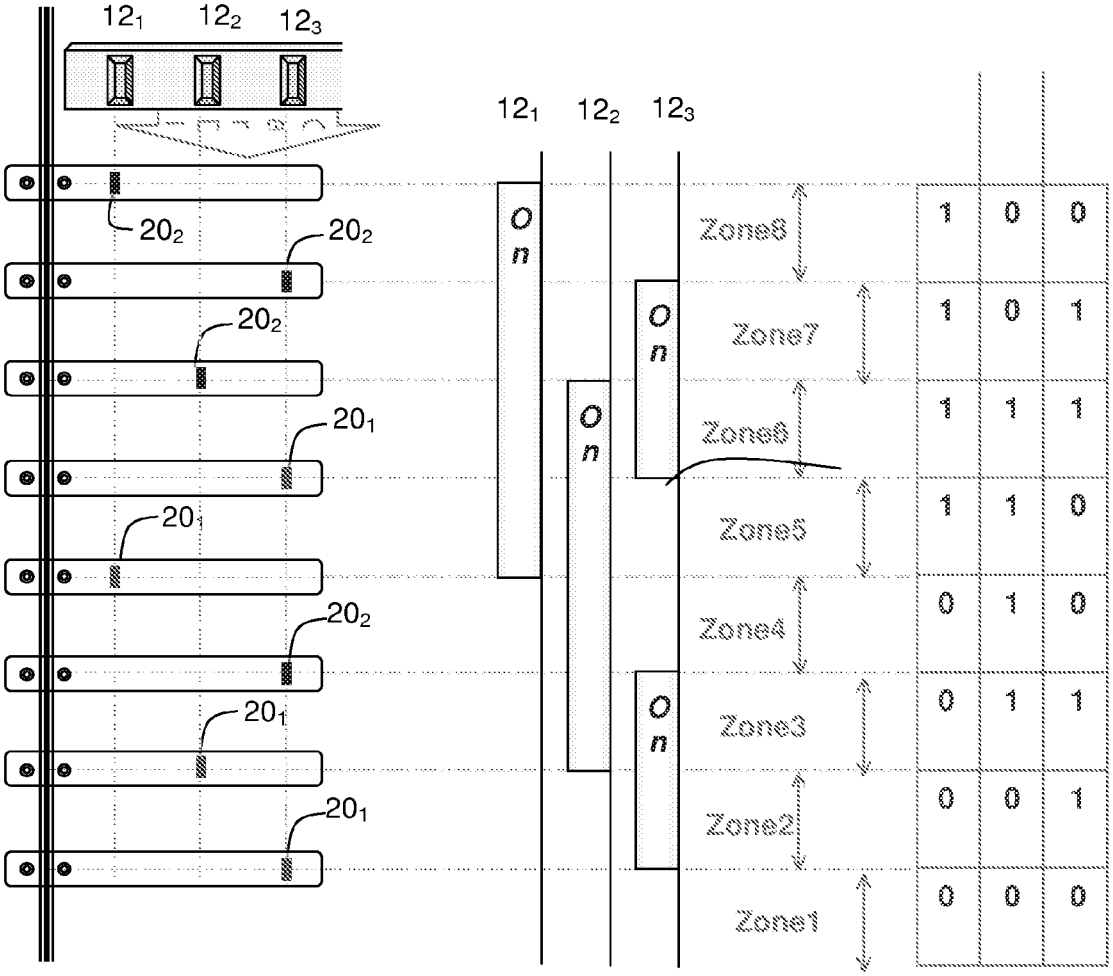
FIG. 3 depicts the bottom NTSD zone.

FIG. 3 depicts the bottom NTSD zone, the on and off states of the sensors 12 and the zone code 30 generated by the three sensors 12 as the car travels along the bottom zones. Operation is similar to that described above with reference to FIG. 2. The zone code 30 is initially 000 as the car enters the bottom zones and the zone code 30 follows the same pattern as when the car 10 is traveling upwards through the top zones. As noted above with reference to FIG. 2, the direction of travel of car 10 and the characteristic of the sense element 20 controls the state of the sensors 12. As only one sense element 20 is mounted at each transition between zones, the zone code 30 is a gray code with a single bit changing with each transition.

Figure 4:
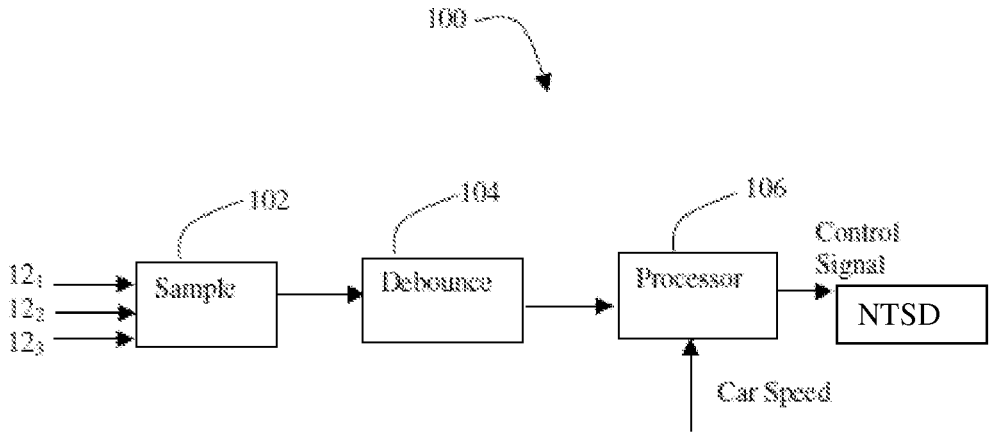
FIG. 4 depicts a control system.

FIG. 4 is a block diagram of an exemplary control system 100. Control system 100 includes a sampling unit 102 for receiving the zone code 30 from the sensors $12_1$, $12_2$ and $12_3$. The sampling unit 102 may sample the value of sensors 12 periodically (e.g., once per millisecond) to effectively continuously monitor the zone code. The signals from sensors $12_1$, $12_2$ and $12_3$ are provided to a debounce unit 104, which serves to debounce the signals. Debouncing may involve detecting a transition in the state of the signal from a sensor 12 and then pausing until the signal stabilizes before accepting the signal value.

A controller 106 receives the zone code 30 and issues control signals, as needed. The controller 106 may be implemented with one or more processors executing computer program code, memory adapted to store software programs and data structures, input-output devices, etc. The controller 106 may also receive other inputs, such as elevator car speed. In an exemplary embodiment, the controller determines when the car 10 is entering a terminal zone (e.g., top or bottom) and determines if the car speed is acceptable. If not, a control signal is generated to initiate the NTSD to reduce car speed in the terminal zones. As the zone code 30 for the top zone and bottom zone follows the same pattern (from entry to the terminal zone), controller 106 can be simplified to detect when the terminal zone is approaching.

In alternate embodiments, the top zone codes 30 and the bottom zone codes 30 are different and follow a different pattern. This can be useful in determining whether the car is in the top zone or bottom zone. Processor 106 can determine which zone the car is in by analyzing the zone code 30.

Technical effects of exemplary embodiments include providing a mechanism for accurately determining the zone of an elevator car. The determination of the zone of the elevator car may then be used to determine whether certain safety initiatives are warranted.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for monitoring elevator car travel, the system comprising:

a plurality of bi-stable sensors traveling with an elevator car;

a plurality of sense elements positioned along a path of the sensors;

the sense elements causing the sensors to assume one of a first state and a second state;

wherein states of the sensors define a zone code identifying a zone corresponding to the elevator car position, the zone code being a gray code, the zone code used to control a stopping device associated with the elevator car;

wherein the sense elements include a first sense element having a first characteristic and a second sense element having a second characteristic different from the first characteristic;

wherein a first sense element causes a first bi-stable sensor to assume a first state when the car is traveling in a first direction, the first sense element causing the first bi-stable sensor to assume a second state when the elevator car is traveling in a second direction, the second direction opposite the first direction.

2. The system of claim 1 wherein:

the first sense element is a north polarity magnet and the second sense element is a south polarity magnet.

3. The system of claim 2 wherein:

the sensors are bi-stable reed switches.

4. The system of claim 1 wherein:

the sense elements are arranged in a top zone and a bottom zone.

5. The system of claim 4 wherein:

the zone code generated as the elevator car travels through the top zone is identical to the zone code generated as the elevator car travels through the bottom zone.

6. The system of claim 4 wherein:

the zone code generated as the elevator car travels through the top zone is different than the zone code generated as the elevator travels through the bottom zone.

7. The system of claim 1 further comprising:

a control system receiving the zone code from the sensors and generating a control signal in response to the zone code.

8. The system of claim 7 wherein:

the control system includes a debounce unit for debouncing signals received from the sensors.

9. The system of claim 7 wherein:

the control system includes a controller receiving an elevator car speed signal and the zone code, the controller generating the control signal in response to the elevator car speed signal and the zone code, the control signal initiating a normal terminal stopping device.

10. A method for monitoring elevator car travel, the method comprising:

positioning a plurality of bi-stable sensors to travel with an elevator car;

positioning a plurality of sense elements along a path of the sensors;

the sense elements causing the sensors to assume one of a first state and a second state;

obtaining states of the sensors, wherein the states of the sensors define a zone code identifying a zone corresponding to the elevator car position, the zone code being a gray code stopping the elevator car in response to the zone code;

wherein the sense elements include a first sense element having a first characteristic and a second sense element having a second characteristic;

a first sense element causes a first bi-stable sensor to assume a first state when the car is traveling in a first direction, the first sense element causing the first bi-stable sensor to assume a second state when the elevator car is traveling in a second direction, the second direction opposite the first direction.

11. The method of claim 10 wherein:

the first sense element is a north polarity magnet, the second sense element is a south polarity magnet and the sensors are bi-stable reed switches.

12. The method of claim 10 wherein:

the sense elements are arranged in a top zone and a bottom zone.

13. The method of claim 12 wherein:

the zone code generated as the elevator car travels through the top zone is identical to the zone code generated as the elevator car travels through the bottom zone.

14. The method of claim 12 wherein:

the zone code generated as the elevator car travels through the top zone is different than the zone code generated as the elevator travels through the bottom zone.

15. The system of claim 14 wherein:

generating a control signal includes receiving an elevator car speed signal and the zone code and generating the control signal in response to the elevator car speed signal and the zone code, the control signal initiating a normal terminal stopping device.

16. The method of claim 10 further comprising:

receiving the zone code from the sensors and generating a control signal in response to the zone code.

* * * * *